US009437950B2

(12) United States Patent
Koguchi et al.

(10) Patent No.: US 9,437,950 B2
(45) Date of Patent: Sep. 6, 2016

(54) BOARD-TO-BOARD CONNECTOR ASSEMBLY

(71) Applicant: Japan Aviation Electronics Industry, Ltd., Tokyo (JP)

(72) Inventors: Mitsuo Koguchi, Tokyo (JP); Yu Tatebe, Tokyo (JP)

(73) Assignee: Japan Aviation Electronics Industry, Ltd., Tokyo (JP)

( * ) Notice: Subject to any disclaimer, the term of this patent is extended or adjusted under 35 U.S.C. 154(b) by 0 days.

(21) Appl. No.: 14/793,317

(22) Filed: Jul. 7, 2015

(65) Prior Publication Data

US 2016/0036148 A1 Feb. 4, 2016

(30) Foreign Application Priority Data

Aug. 1, 2014 (JP) ..... 2014-157579

(51) Int. Cl.

| | |
|---|---|
| ***H01R 12/00*** | (2006.01) |
| ***H01R 12/71*** | (2011.01) |
| ***H01R 13/115*** | (2006.01) |
| ***H01R 13/6471*** | (2011.01) |
| *H01R 13/28* | (2006.01) |
| *H01R 4/48* | (2006.01) |
| *H01R 12/73* | (2011.01) |

(52) U.S. Cl.

CPC ..... *H01R 12/716* (2013.01); *H01R 13/115* (2013.01); *H01R 13/6471* (2013.01); *H01R 4/48* (2013.01); *H01R 12/718* (2013.01); *H01R 12/732* (2013.01); *H01R 13/28* (2013.01)

(58) Field of Classification Search

USPC ..... 439/65, 74, 290, 291, 295

See application file for complete search history.

(56) References Cited

U.S. PATENT DOCUMENTS

| | | | | |
|---|---|---|---|---|
| 6,093,035 | A | 7/2000 | Lemke et al. | |
| 6,193,537 | B1 * | 2/2001 | Harper, Jr. | H01R 13/28 439/291 |
| 7,179,095 | B1 * | 2/2007 | Peng | H01R 12/7052 439/290 |
| 8,998,645 | B2 * | 4/2015 | Vanaleck | H01R 13/28 439/626 |
| 2005/0020109 | A1 | 1/2005 | Raistrick et al. | |
| 2014/0017957 | A1 | 1/2014 | Horchler et al. | |

FOREIGN PATENT DOCUMENTS

JP H04308674 A 10/1992

OTHER PUBLICATIONS

Extended European Search Report of EP15175353 dated Oct. 13, 2015, 7pgs.

* cited by examiner

*Primary Examiner* — Tho D Ta
(74) *Attorney, Agent, or Firm* — Maier & Maier, PLLC

(57) ABSTRACT

A plurality of upper plug contacts are each brought into contact with a master elastic piece and a slave elastic piece of a corresponding lower receptacle contact in accordance with elastic deformation of the master elastic piece and the slave elastic piece. A plurality of lower plug contacts are each brought into contact with a master elastic piece and a slave elastic piece of a corresponding upper receptacle contact in accordance with elastic deformation of the master elastic piece and the slave elastic piece. For example, as shown in FIG. 7, in a state where an upper connector and a lower connector are mated, a direction of the elastic deformation of the master elastic piece and the slave elastic piece of each upper receptacle contact is different from a direction of the elastic deformation of the master elastic piece and the slave elastic piece of each lower receptacle contact.

12 Claims, 13 Drawing Sheets

RELATED ART

BOARD-TO-BOARD CONNECTOR ASSEMBLY

INCORPORATION BY REFERENCE

This application is based upon and claims the benefit of priority from Japanese patent application No. 2014-157579, filed on Aug. 1, 2014, the disclosure of which is incorporated herein in its entirety by reference.

BACKGROUND OF THE INVENTION

1. Field of the Invention

The present invention relates to a connector assembly.

2. Description of Related Art

As a technique of this type, Japanese Unexamined Patent Application Publication No. H04-308674 discloses a connector 102 that electrically connects an upper electronic circuit board 100 and a lower electronic circuit board 101 to each other as shown in FIG. 11 of this application. The connector 102 includes a plurality of upper male contacts 103, a plurality of upper female contacts 104, a plurality of lower male contacts 105, and a plurality of lower female contacts 106. The plurality of upper male contacts 103 and the plurality of upper female contacts 104 are alternately arranged on the upper electronic circuit board 100. The plurality of lower male contacts 105 and the plurality of lower female contacts 106 are alternately arranged on the lower electronic circuit board 101. The upper male contacts 103 protrude with respect to the upper female contacts 104, and are respectively received by the lower female contacts 106. The lower male contacts 105 protrude with respect to the lower female contacts 106, and are respectively received by the upper female contacts 104. With this structure, the connector 102 with a fine pitch is achieved.

In the connector disclosed in Japanese Unexamined Patent Application Publication No. H04-308674, the upper male contacts 103 and the upper female contacts 104 may be arranged in a staggered manner.

However, in the structure disclosed in Japanese Unexamined Patent Application Publication No. H04-308674, a fine pitch is achieved at the expense of not being able to achieve a low profile, which is one of the basic characteristics of connectors.

In view of the above-mentioned circumstances, an object of the present invention is to provide a technique to achieve a fine pitch and a low profile at the same time in a grid array connector assembly.

SUMMARY OF THE INVENTION

An exemplary aspect of the present invention is a connector assembly including: a first connector including a plurality of first plug contacts and a plurality of first receptacle contacts each having a first elastic piece, the plurality of first plug contacts and the plurality of first receptacle contacts being alternately arranged in a grid array; and a second connector including a plurality of second plug contacts and a plurality of second receptacle contacts each having a second elastic piece, the plurality of second plug contacts and the plurality of second receptacle contacts being alternately arranged in a grid array. The plurality of first plug contacts are each brought into contact with the second elastic piece of the corresponding second receptacle contact in accordance with elastic deformation of the second elastic piece. The plurality of second plug contacts are each brought into contact with the first elastic piece of the corresponding first receptacle contact in accordance with elastic deformation of the first elastic piece. A direction of the elastic deformation of the first elastic piece is different from a direction of the elastic deformation of the second elastic piece in a state in which the first connector and the second connector are mated.

According to the present invention, a fine pitch and a low profile are achieved at the same time in a grid array connector assembly.

The above and other objects, features and advantages of the present invention will become more fully understood from the detailed description given hereinbelow and the accompanying drawings which are given by way of illustration only, and thus are not to be considered as limiting the present invention.

DESCRIPTION OF THE EXEMPLARY EMBODIMENTS

Figure 1:
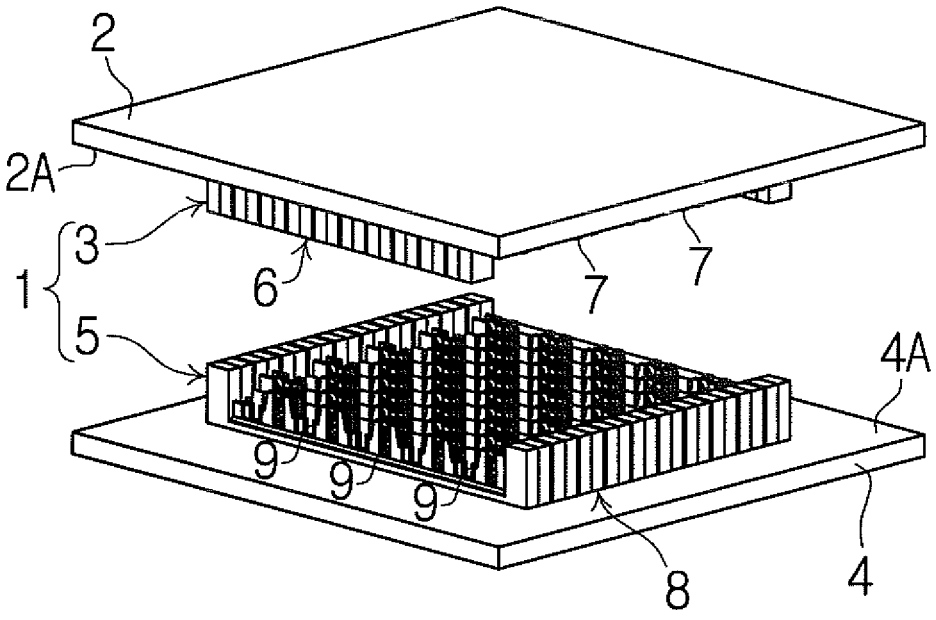
FIG. 1 is a perspective view showing a state before mating of a connector assembly.
Figure 2:
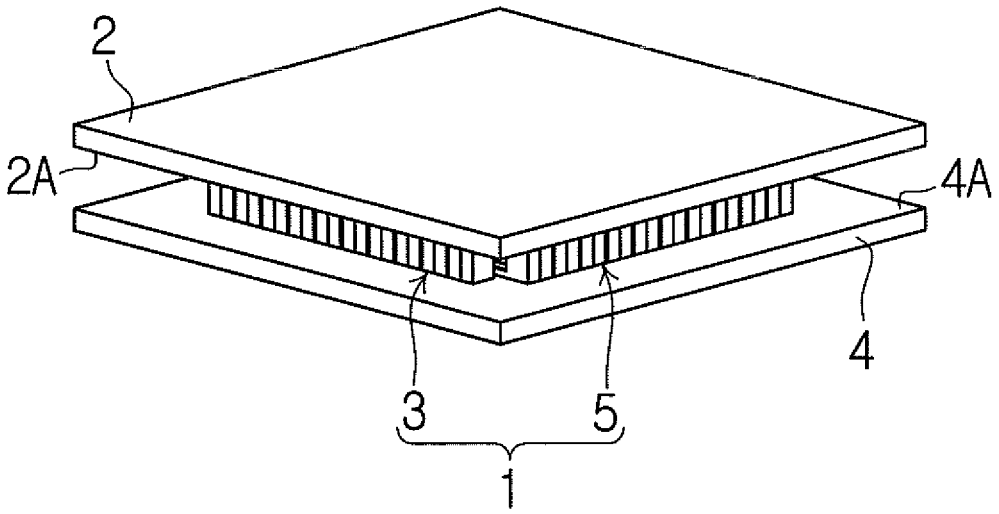
FIG. 2 is a perspective view showing a mated state of the connector assembly.

FIG. 1 shows a state before mating of a connector assembly 1 (board-to-board connector assembly). FIG. 2 shows a mated state of the connector assembly 1. As shown in FIG. 1, the connector assembly 1 includes an upper connector 3 (first connector) and a lower connector 5 (second connector). The upper connector 3 is mounted on a connector mounting surface 2A of an upper board 2 (first board). The lower connector 5 is mounted on a connector mounting surface 4A of a lower board 4 (second board). When the upper connector 3 is mated with the lower connector 5 as shown in FIG. 2, conductive patterns (not shown) on the upper board 2 and conductive patterns (not shown) on the lower board 4 are electrically connected to each other.

As shown in FIG. 1, the upper connector 3 includes an upper housing 6 (first housing) and a plurality of upper contacts 7 (first contacts) arranged in a 10×10 matrix grid array. Similarly, the lower connector 5 includes a lower housing 8 (second housing) and a plurality of lower contacts 9 (second contacts) arranged in a 10×10 matrix grid array. The connector assembly 1 has 500 micrometers pitch.

Figure 3:
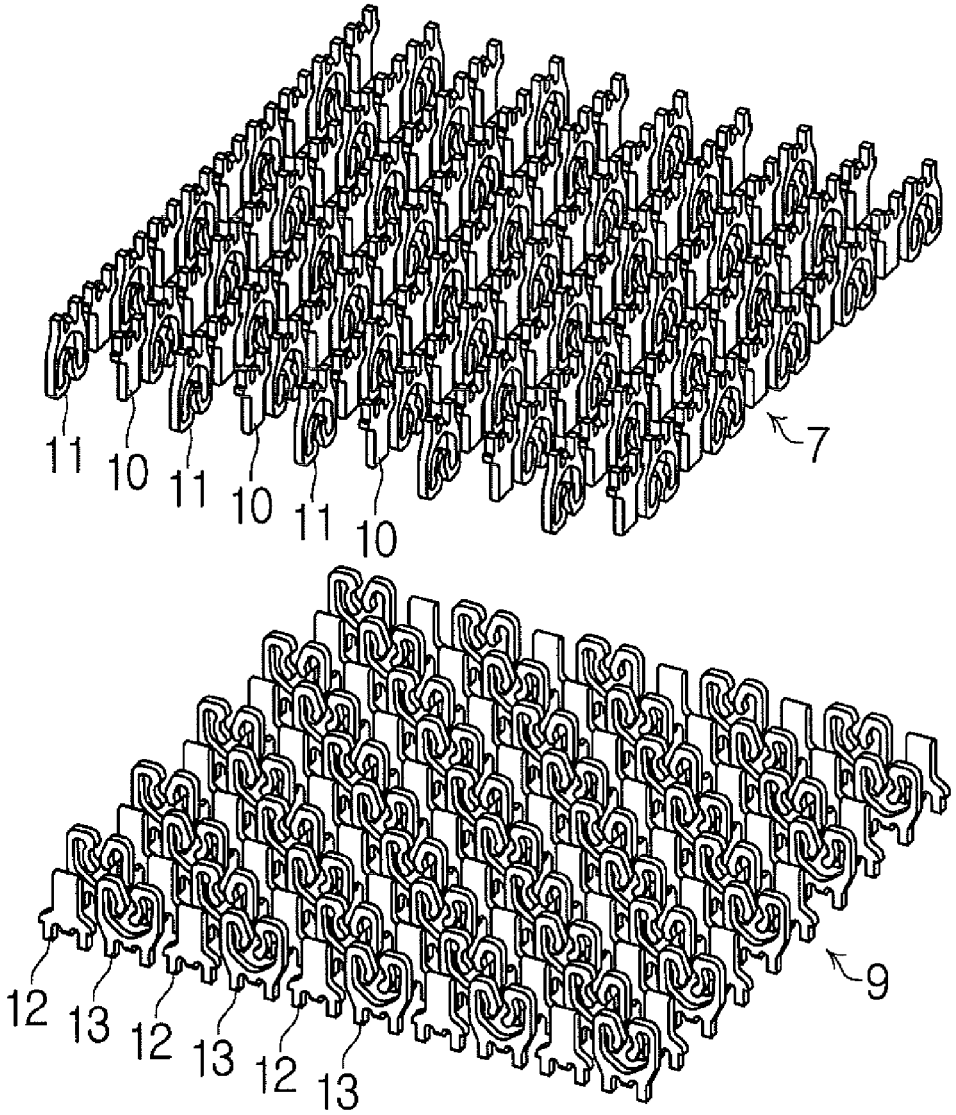
FIG. 3 is a perspective view illustrating only contacts of the connector assembly before mating.

FIG. 3 shows a state in which the plurality of upper contacts 7 and the plurality of lower contacts 9 are slightly spaced apart from each other and face each other in the vertical direction.

Specifically, as shown in FIG. 3, the plurality of upper contacts 7, which are arranged in the 10×10 matrix grid array, are configured by alternately arranging a plurality of upper plug contacts 10 (first plug contacts) and a plurality of upper receptacle contacts 11 (first receptacle contacts) in a grid array. Accordingly, the upper plug contacts 10 and the upper receptacle contacts 11 are alternately arranged in row and column directions.

Similarly, the plurality of lower contacts 9, which are arranged in the 10×10 matrix grid array, are configured by alternately arranging a plurality of lower plug contacts 12 (second plug contacts) and a plurality of lower receptacle contacts 13 (second receptacle contacts) in a grid array. Accordingly, the lower plug contacts 12 and the lower receptacle contacts 13 are alternately arranged in the row and column directions.

In this exemplary embodiment, since the upper plug contacts 10 and the lower plug contacts 12 have the same planar shape, repeated explanation is omitted in the description of the upper plug contacts 10 and the lower plug contacts 12. Similarly, since the upper receptacle contacts 11 and the lower receptacle contacts 13 have the same planar shape, repeated explanation is omitted in the description of the upper receptacle contacts 11 and the lower receptacle contacts 13. Further, since the upper connector 3 and the lower connector 5 have substantially the same shape, repeated explanation is omitted in the description of the upper connector 3 and the lower connector 5.

Figure 4:
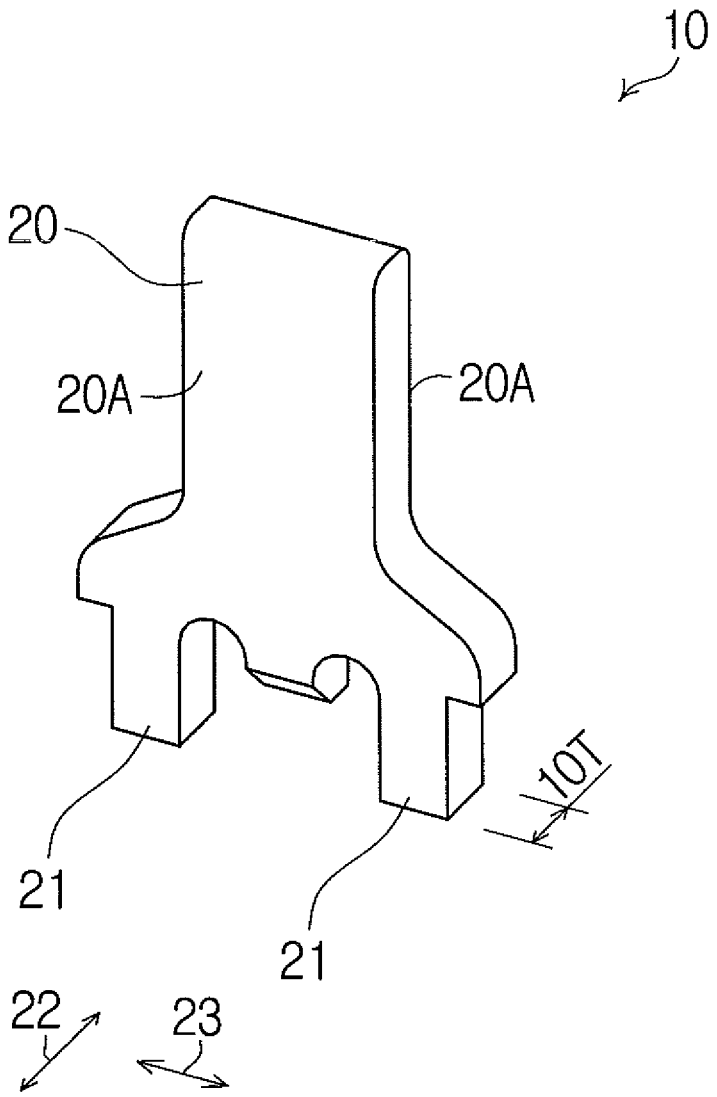
FIG. 4 is a perspective view of an upper plug contact.
Figure 5:
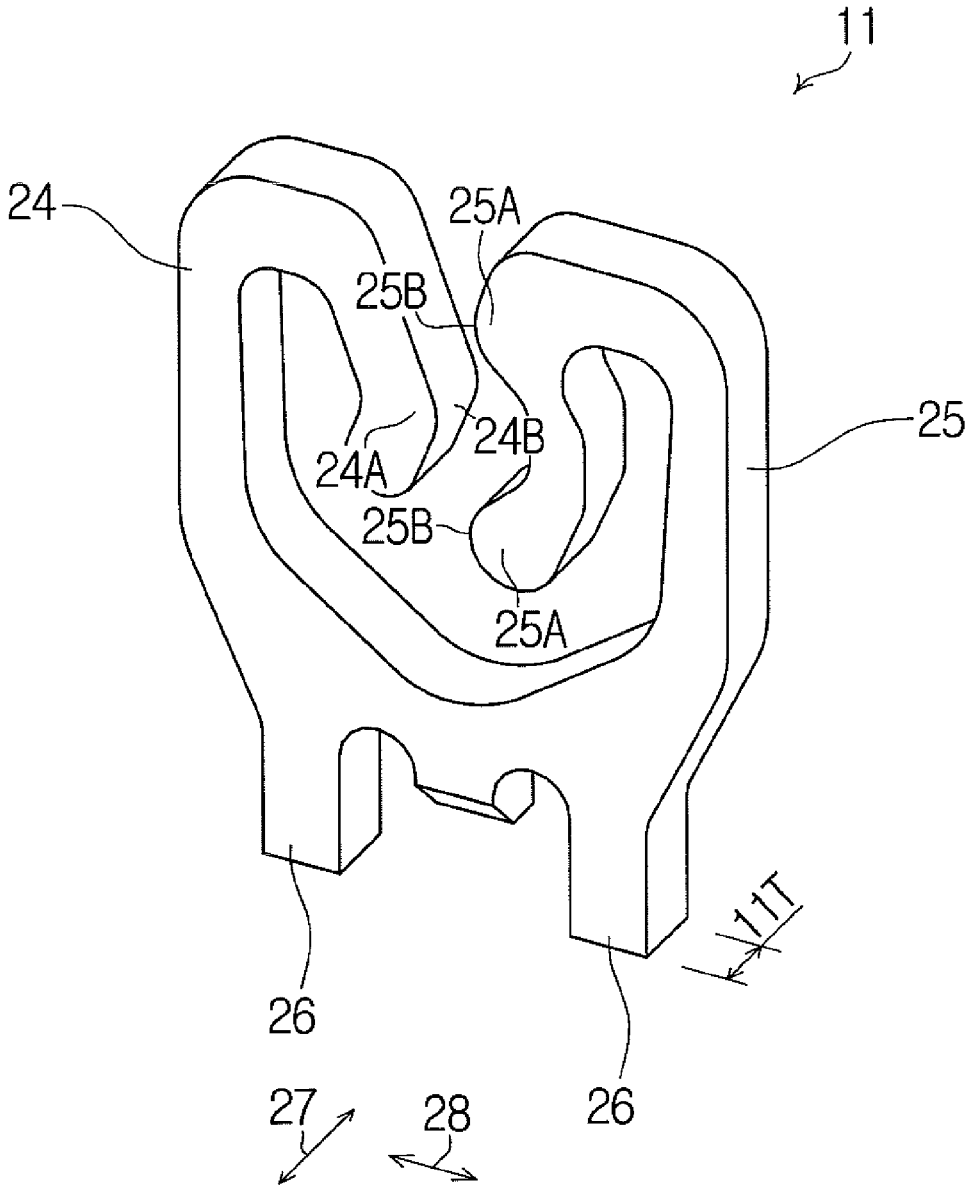
FIG. 5 is a perspective view of an upper receptacle contact.

FIG. 4 shows the upper plug contact 10. FIG. 5 shows the upper receptacle contact 11. The upper plug contact 10 and the upper receptacle contact 11 are each formed into a flat plate shape by punching a metallic plate. In other words, each of the upper plug contact 10 and the upper receptacle contact 11 is a partially-removed flat plate.

As shown in FIG. 4, the upper plug contact 10 includes a contact portion 20 having a flat plate shape, and two solder leg portions 21 each projecting from the contact portion 20. The upper plug contact 10 has a thickness 10T (for example, 80 micrometers). The two solder leg portions 21 are formed so as to project in the same direction from the contact portion 20. The two solder leg portions 21 are slightly spaced apart from each other. In FIG. 4, a thickness direction 22 of the upper plug contact 10 and a lateral direction 23 which is a direction perpendicular to the thickness direction 22 are indicated by arrows. In this exemplary embodiment, the lateral direction 23 coincides with the direction in which the two solder leg portions 21 face each other. The contact portion 20 includes two principal surfaces 20A.

As shown in FIG. 5, the upper receptacle contact 11 includes a master elastic piece 24 (first elastic piece), a slave elastic piece 25 (first elastic piece), and two solder leg portions 26. The master elastic piece 24 and the slave elastic piece 25 have an asymmetrical shape. The shape of the master elastic piece 24 is different from that of the slave elastic piece 25. The master elastic piece 24 includes one contact portion 24A. The slave elastic piece 25 includes two contact portions 25A. The upper receptacle contact 11 has a thickness 11T (for example, 80 micrometers). The two solder leg portions 26 are formed so as to project in the same direction. The two solder leg portions 26 are arranged so as to be slightly spaced apart from each other. In FIG. 5, a thickness direction 27 of the upper receptacle contact 11 and a lateral direction 28 which is a direction perpendicular to the thickness direction 27 are indicated by arrows. In this exemplary embodiment, the lateral direction 28 coincides with the direction in which the two solder leg portions 26 face each other. The master elastic piece 24 and the slave elastic piece 25 are formed so as to facilitate elastic deformation mainly in the lateral direction 28. The contact portion 24A of the master elastic piece 24 has a cut-surface 24B which is formed during the punching process. Each contact portion 25A of the slave elastic piece 25 has a cut-surface 25B which is formed during the punching process. The term "cut-surface" used herein refers to a so-called shear surface or fracture surface. Instead of the term "cut-surface", "end face" can be used. The master elastic piece 24 and the slave elastic piece 25 face each other in the lateral direction 28.

The upper plug contact 10 and the upper receptacle contact 11 are simultaneously formed by punching a metallic plate. Accordingly, the thickness 10T of the upper plug contact 10 is equal to the thickness 11T of the upper receptacle contact 11.

Figure 6:
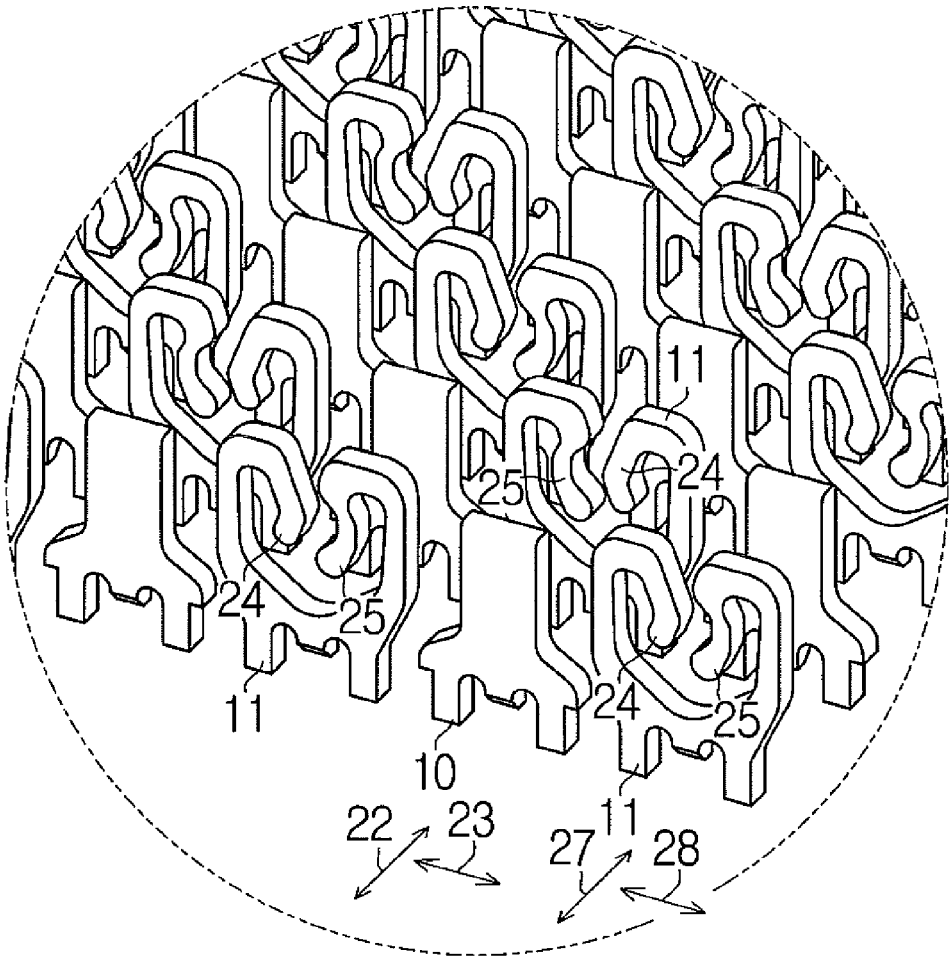
FIG. 6 is a perspective view of upper plug contacts and upper receptacle contacts which are arranged in a grid array.

FIG. 6 is an enlarged view of the plurality of upper plug contacts 10 and the plurality of upper receptacle contacts 11. As shown in FIG. 6, the thickness direction 22 of each upper plug contact 10 is the same as the thickness direction 27 of each upper receptacle contact 11 which is adjacent to the upper plug contact 10 in the lateral direction 23. Similarly, the thickness direction 22 of each upper plug contact 10 is the same as the thickness direction 27 of each upper receptacle contact 11 which is adjacent to the upper plug contact 10 in the thickness direction 22.

FIG. 6 illustrates the plurality of upper receptacle contacts 11. The positional relations between the master elastic piece 24 and the slave elastic piece 25 of the plurality of upper receptacle contacts 11 are not unified. In the example shown in FIG. 6, the positional relations between the master elastic piece 24 and the slave elastic piece 25 of two upper receptacle contacts 11, which are adjacent to the upper plug contact 10 in the lateral direction 23, are the same, whereas the positional relation between the master elastic piece 24 and the slave elastic piece 25 of the upper receptacle contact 11 adjacent to the upper plug contact 10 in the lateral direction 23 is opposite to the positional relation between the master elastic piece 24 and the slave elastic piece 25 of the upper receptacle contact 11 adjacent to the upper plug contact 10 in the thickness direction 22. In other words, the upper receptacle contact 11 adjacent to the upper plug contact 10 in the lateral direction 23 and the upper receptacle contact 11 adjacent to the upper plug contact 10 in the thickness direction 22 are reversely positioned with respect to each other.

Figure 7:
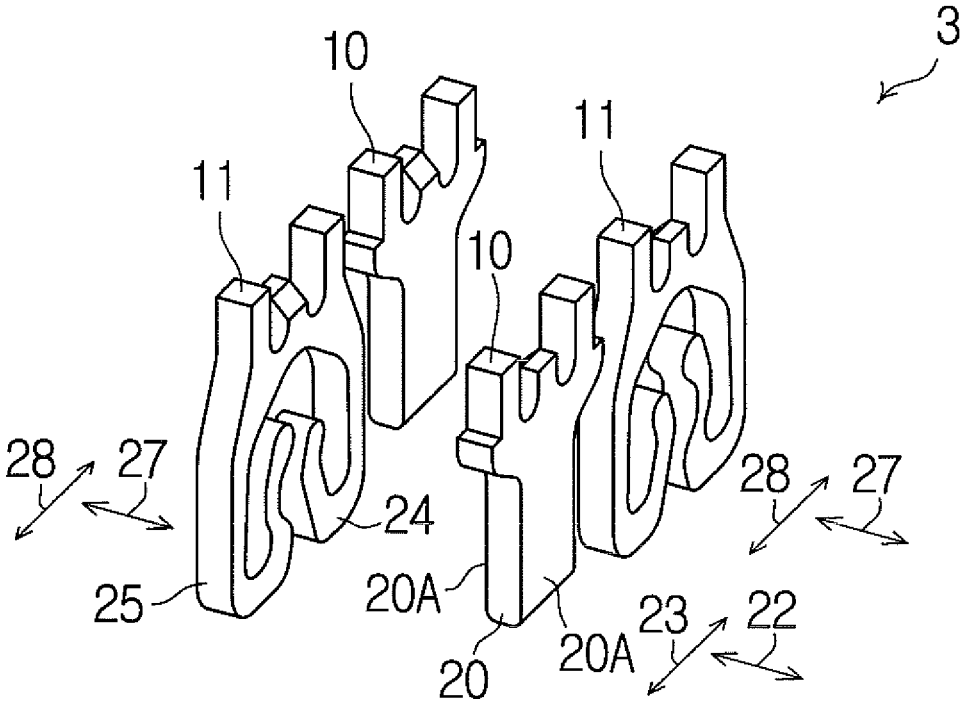
FIG. 7 is a perspective view illustrating only some of the contacts of the connector assembly before mating.
Figure 7:
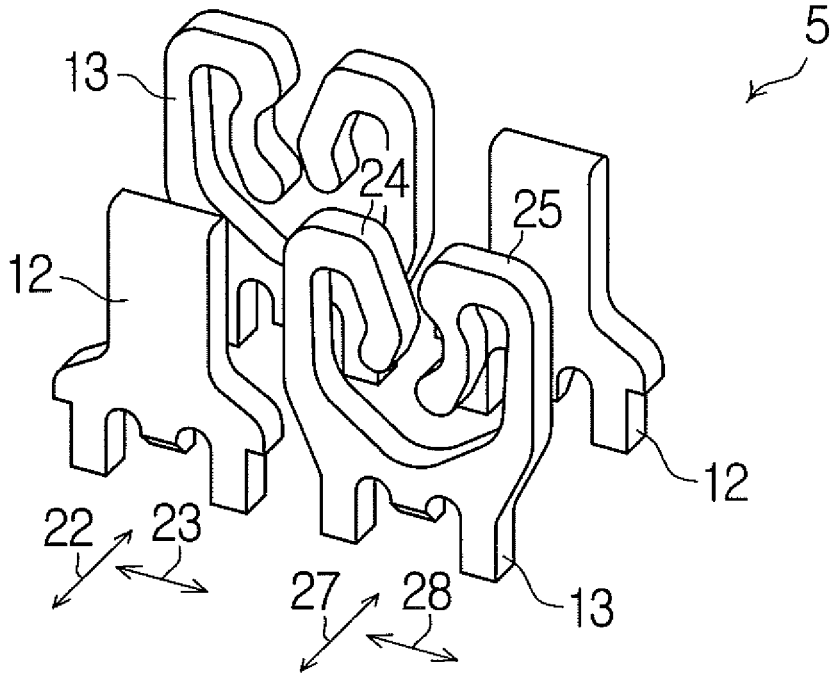

FIG. 7 shows a state in which two upper plug contacts 10 and two upper receptacle contacts 11 that are included in the upper connector 3 face two lower receptacle contacts 13 and two lower plug contacts 12 that are included in the lower connector 5, respectively, in the vertical direction. As shown in FIG. 7, before the upper connector 3 and the lower connector 5 are mated, the thickness direction 22 of each upper plug contact 10 of the upper connector 3 and the thickness direction 22 of each lower plug contact 12 of the lower connector 5 are perpendicular to each other in a plan view, i.e., when viewed along the direction perpendicular to the connector mounting surface 2A of the upper board 2.

When the upper connector 3 is moved toward the lower connector 5 from the state shown in FIG. 7, the contact portion 20 of each upper plug contact 10 is inserted between the master elastic piece 24 and the slave elastic piece 25 of the corresponding lower receptacle contact 13, and the master elastic piece 24 and the slave elastic piece 25 are elastically deformed in such a manner that the master elastic piece 24 and the slave elastic piece 25 are spaced apart from each other in the lateral direction 28. Further, one of the principal surfaces 20A of the contact portion 20 is brought into contact with the cut-surface 24B of the contact portion 24A (also see FIG. 5) of the master elastic piece 24, and the other principal surface 20A of the contact portion 20 is brought into contact with the cut-surfaces 25B of the two contact portions 25A (also see FIG. 5) of the slave elastic piece 25, with the result that the upper plug contact 10 and the lower receptacle contact 13 are electrically connected to each other at three locations. The same holds true for the upper receptacle contact 11 and the lower plug contact 12.

As shown in FIG. 7, when the upper connector 3 and the lower connector 5 are mated, the direction in which the master elastic piece 24 and the slave elastic piece 25 of each lower receptacle contact 13 are elastically deformed and the direction in which the master elastic piece 24 and the slave elastic piece 25 of each upper receptacle contact 11 are elastically deformed are directions different from each other by 90 degrees. This contributes to a fine pitch of the connector assembly 1, as compared with the case where the both directions are the same.

Furthermore, as shown in FIG. 7, each lower plug contact 12 is formed in such a manner that the lower plug contact 12 is narrowed at a leading end thereof, the leading end projecting toward the upper connector 3. Accordingly, when the master elastic piece 24 of each lower receptacle contact 13 adjacent to the lower plug contact 12 in the lateral direction 23 is elastically deformed toward the lower plug contact 12, the master elastic piece 24 is less likely to come into contact with the lower plug contact 12. Thus, the shape of each lower plug contact 12 that is narrowed at a leading end thereof contributes to a fine pitch of the connector assembly 1.

Figure 8:
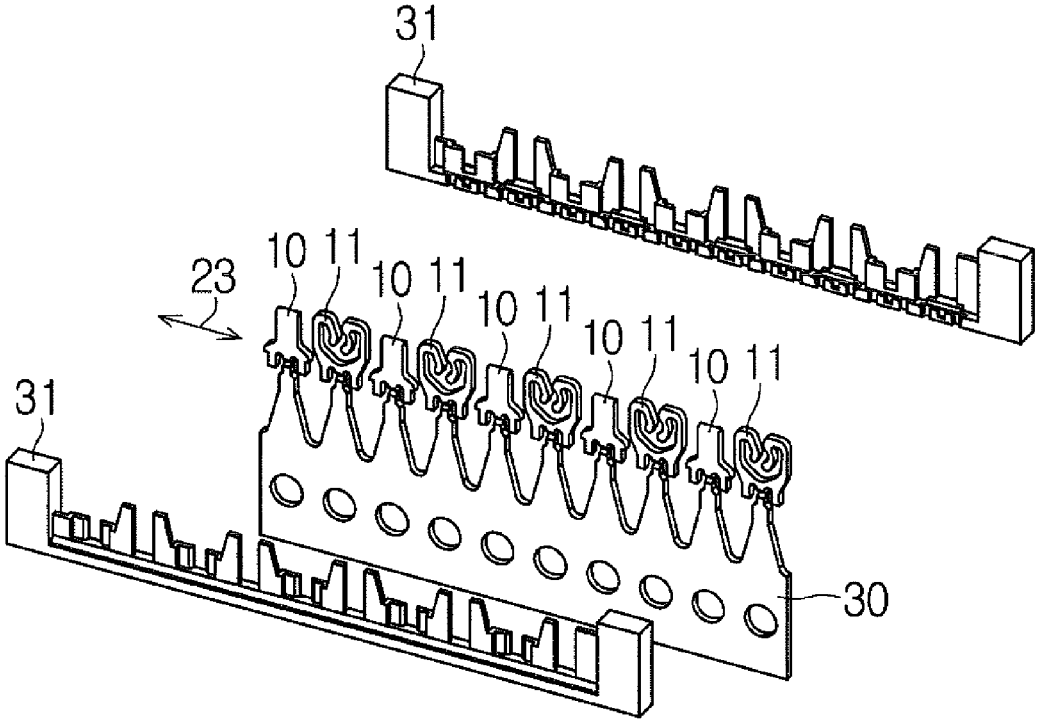
FIG. 8 shows a production flow of an upper connector.
Figure 9:
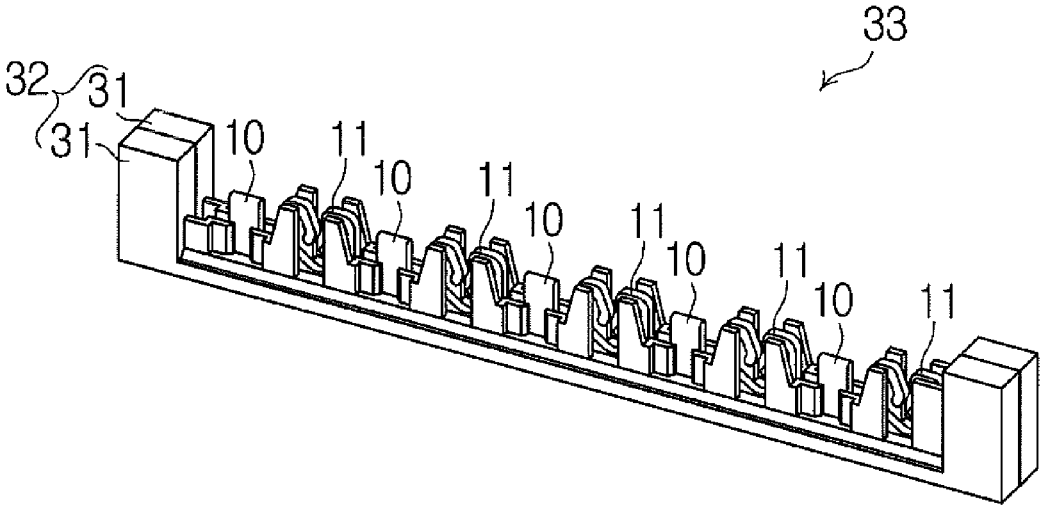
FIG. 9 shows a production flow of the upper connector.
Figure 10:
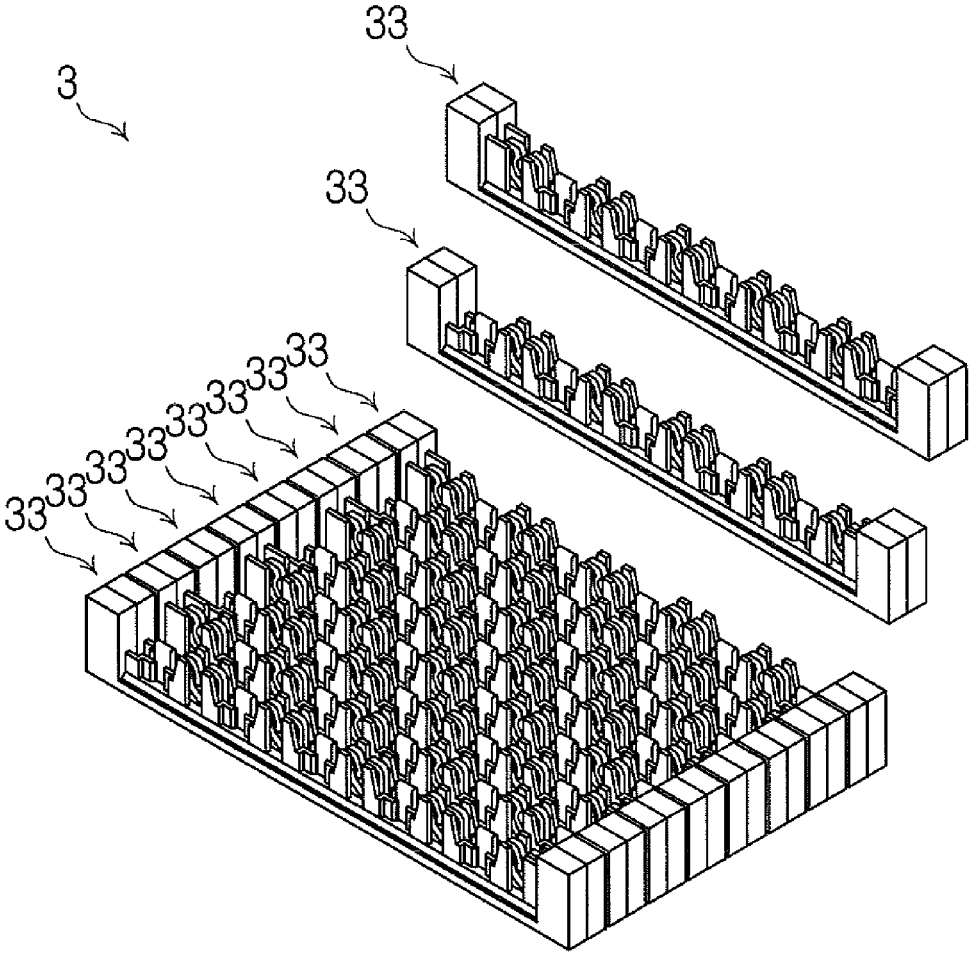
FIG. 10 is a production flow of the upper connector.
Figure 11:
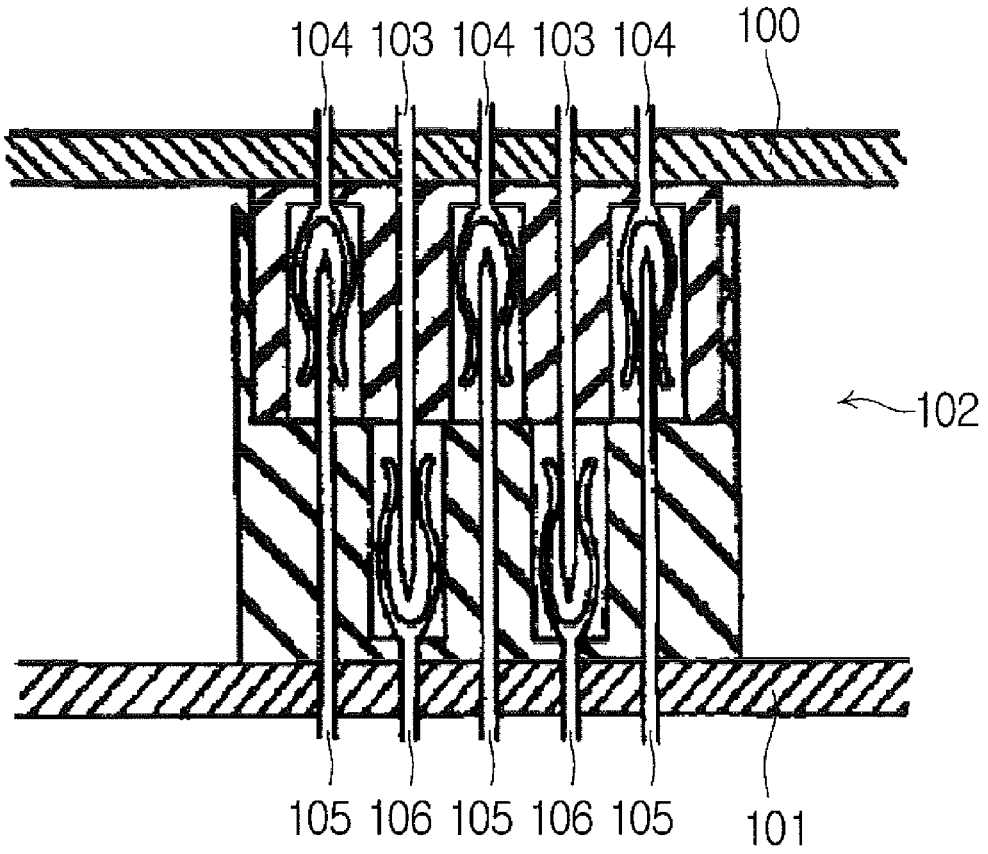
FIG. 11 corresponds to FIG. 1 of Japanese Unexamined Patent Application Publication No. H04-308674.

Next, a production flow of the upper connector 3 will be described. First, as shown in FIG. 8, the plurality of upper plug contacts 10 and the plurality of upper receptacle contacts 11 that are alternately arranged in the lateral direction 23 of the upper plug contact 10 are simultaneously formed by punching a single metallic plate. At this stage, the plurality of upper plug contacts 10 and the plurality of upper receptacle contacts 11 are held by a common carrier 30. Next, as shown in FIGS. 8 and 9, the plurality of upper plug contacts 10 and the plurality of upper receptacle contacts 11 that are held by the common carrier 30 are sandwiched by two holding members 31 each elongated in the lateral direction 23 of each upper plug contact 10. The two holding members 31 are mutually fixed by means of, for example, adhesion. Since the need for the carrier 30 is eliminated at this stage, the carrier 30 is separated and removed from the plurality of upper plug contacts 10 and the plurality of upper receptacle contacts 11. The two holding members 31 shown in FIG. 9 constitute a housing divided body 32. One housing divided body 32 and the plurality of upper plug contacts 10 and the plurality of upper receptacle contacts 11 that are held by the housing divided body 32 constitute a connector divided body 33. Lastly, as shown in FIG. 10, a plurality of connector divided bodies 33 corresponding to a necessary number of contact points are prepared, and the plurality of connector divided bodies 33 are connected to each other, to thereby complete the upper connector 3.

Preferred exemplary embodiments of the present invention described above have the following features.

(1) The connector assembly 1 includes: the upper connector 3 (first connector) including the plurality of upper plug contacts 10 (first plug contacts) and the plurality of upper receptacle contacts 11 (first receptacle contacts) each having the master elastic piece 24 (first elastic piece) and the slave elastic piece 25 (first elastic piece), the plurality of upper plug contacts 10 and the plurality of upper receptacle contacts 11 being alternately arranged in a grid array; and the lower connector 5 (second connector) including the plurality of lower plug contacts 12 (second plug contacts) and the plurality of lower receptacle contacts 13 (second receptacle contacts) each having the master elastic piece 24 (second elastic piece) and the slave elastic piece 25 (second elastic piece), the plurality of lower plug contacts 12 and the plurality of lower receptacle contacts 13 being alternately arranged in a grid array. The plurality of upper plug contacts 10 are brought into contact with the master elastic piece 24 and the slave elastic piece 25 of the respective lower receptacle contacts 13 in accordance with elastic deformation of the master elastic piece 24 and the slave elastic piece 25 of the respective lower receptacle contacts 13. The plurality of lower plug contacts 12 are brought into contact with the master elastic piece 24 and the slave elastic piece 25 of the respective upper receptacle contacts 11 in accordance with elastic deformation of the master elastic piece 24 and the slave elastic piece 25 of the respective upper receptacle contacts 11. As is obvious from FIG. 7, for example, in the state in which the upper connector 3 and the lower connector 5 are mated, the direction (lateral direction 28) in which the master elastic piece 24 and the slave elastic piece 25 of each upper receptacle contact 11 are elastically deformed differs from the direction (lateral direction 28) in which the master elastic piece 24 and the slave elastic piece 25 of each lower receptacle contact 13 are elastically deformed. According to the above-mentioned structure, even when the connector assembly 1 is formed in such a manner that the plurality of upper receptacle contacts 11 and the plurality of lower receptacle contacts 13 are aligned at the same level in the state in which the upper connector 3 and the lower connector 5 are mated, the plurality of upper receptacle contacts 11 and the plurality of lower receptacle contacts 13 are less likely to physically interfere with each other. Consequently, a fine pitch and a low profile of the connector assembly 1 can be achieved at the same time.

(2) In the state in which the upper connector 3 and the lower connector 5 are mated, the master elastic piece 24 and the slave elastic piece 25 of each upper receptacle contact 11 are elastically deformed in the direction (lateral direction 28) perpendicular to the thickness direction 27 of each upper receptacle contact 11, and the master elastic piece 24 and the slave elastic piece 25 of each lower receptacle contact 13 are elastically deformed in the direction (lateral direction 28) perpendicular to the thickness direction 27 of each lower receptacle contact 13. The above-mentioned structure contributes to a fine pitch of the connector assembly 1, as compared with a structure in which the master elastic piece 24 and the slave elastic piece 25 of each upper receptacle contact 11 are elastically deformed in the thickness direction 27 of each upper receptacle contact 11 and the master elastic piece 24 and the slave elastic piece 25 of each lower receptacle contact 13 are elastically deformed in the thickness direction 27 of each lower receptacle contact 13 in the state in which the upper connector 3 and the lower connector 5 are mated.

(3) Each upper plug contact 10 and each lower plug contact 12 are formed into a flat plate shape. According to the above-mentioned structure, a reliable contact can be obtained between each upper plug contact 10 and the master elastic piece 24 and the slave elastic piece 25 of the corresponding lower receptacle contact 13 and between each lower plug contact 12 and the master elastic piece 24 and the slave elastic piece 25 of the corresponding upper receptacle contact 11, as compared with a structure in which each upper plug contact 10 and each lower plug contact 12 are formed into a columnar shape.

(4) The thickness direction 22 of each upper plug contact 10 is the same as the thickness direction 27 of each upper receptacle contact 11 adjacent to the upper plug contact 10 in the direction (lateral direction 23) perpendicular to the thickness direction 22 of each upper plug contact 10. According to the above-mentioned structure, the upper plug contacts 10 and the upper receptacle contacts 11 that are adjacent to each other in the lateral direction 23 of each upper plug contact 10 can be simultaneously formed by punching a metallic plate. This contributes to a reduction in manufacturing cost of the upper connector 3.

(5) Each upper plug contact 10 is formed in such a manner that the upper plug contact 10 is narrowed at a leading end thereof, the leading end projecting toward the lower connector 5. According to the above-mentioned structure, the elastic deformation of the master elastic piece 24 and the slave elastic piece 25 of each upper receptacle contacts 11 adjacent to the upper plug contact 10 in the direction (lateral direction 23) perpendicular to the thickness direction 22 of each upper plug contact 10 is less likely to be hindered. This contributes to a fine pitch of the connector assembly 1.

(6) The connector assembly 1 includes the plurality of housing divided bodies 32 (first housing divided bodies). Each housing divided body 32 holds the plurality of upper plug contacts 10 and the plurality of upper receptacle contacts 11 that are alternately arranged in the direction (lateral direction 23) perpendicular to the thickness direction 22 of each upper plug contact 10. According to the above-mentioned structure, there is no need to redesign the housing every time the necessary number of contact points is increased or decreased, and thus the requirements can be satisfied only by preparing a necessary number of housing divided bodies 32 corresponding to the necessary number of contact points.

The upper housing 6 of the upper connector 3 is composed of the plurality of housing divided bodies 32.

(7) Each housing divided body 32 is composed of two holding members 31 that hold the plurality of upper plug contacts 10 and the plurality of upper receptacle contacts 11 that are alternately arranged in the direction (lateral direction 23) perpendicular to the thickness direction 22 of each upper plug contact 10, by sandwiching the plurality of upper plug contacts 10 and the plurality of upper receptacle contacts 11 in the thickness direction 22 of each upper plug contact 10.

The plurality of upper plug contacts 10 and the plurality of upper receptacle contacts 11 may be held by, for example, insert molding.

(8) Each upper receptacle contact 11 includes the master elastic piece 24 and the slave elastic piece 25. The master elastic piece 24 and the slave elastic piece 25 have an asymmetrical shape. That is, the master elastic piece 24 and the slave elastic piece 25 have different shapes. According to the above-mentioned structure, a sufficient punching width can be easily ensured even when the upper receptacle contacts 11 are thin and a severe limitation is imposed on the punching width during press working and etching processes.

(9) Any one of the plurality of upper receptacle contacts 11 is reversely positioned with respect to the other upper receptacle contacts 11. According to the above-mentioned structure, contact pressures generated between the upper receptacle contacts 11 and the lower plug contacts 12 can be cancelled out among the plurality of upper receptacle contacts 11.

In the above exemplary embodiment, the master elastic piece 24 and the slave elastic piece 25 have an asymmetrical shape. In another alternative, the master elastic piece 24 and the slave elastic piece 25 may have a symmetrical shape. One of the master elastic piece 24 and the slave elastic piece 25 may be omitted.

Figure 12:
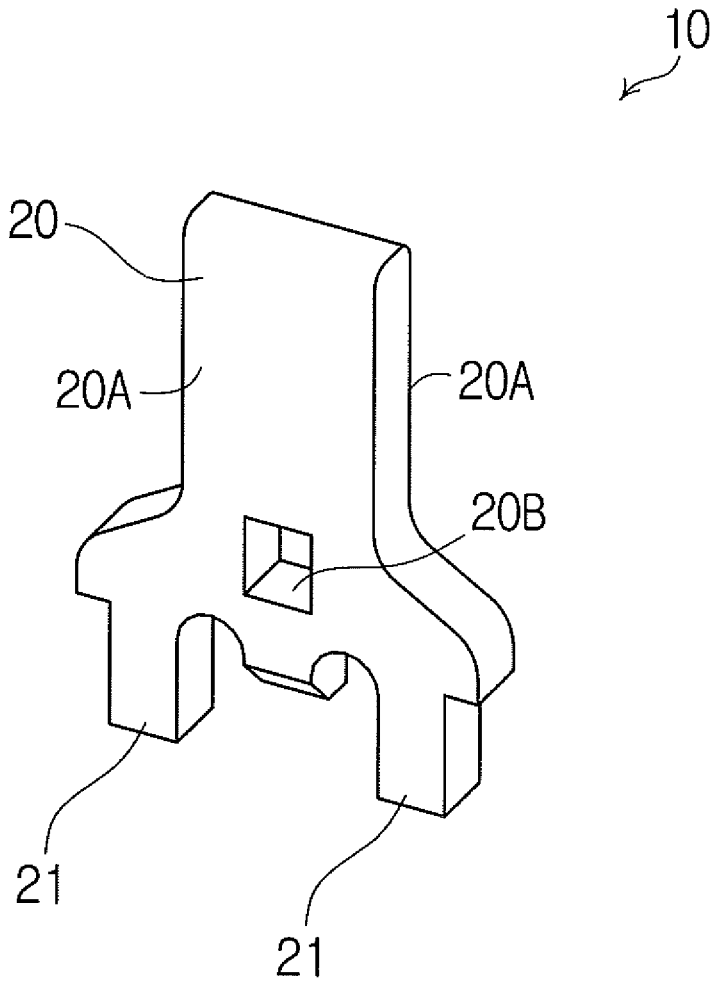
FIG. 12 is a perspective view showing a modified example of the upper plug contact.
Figure 13:
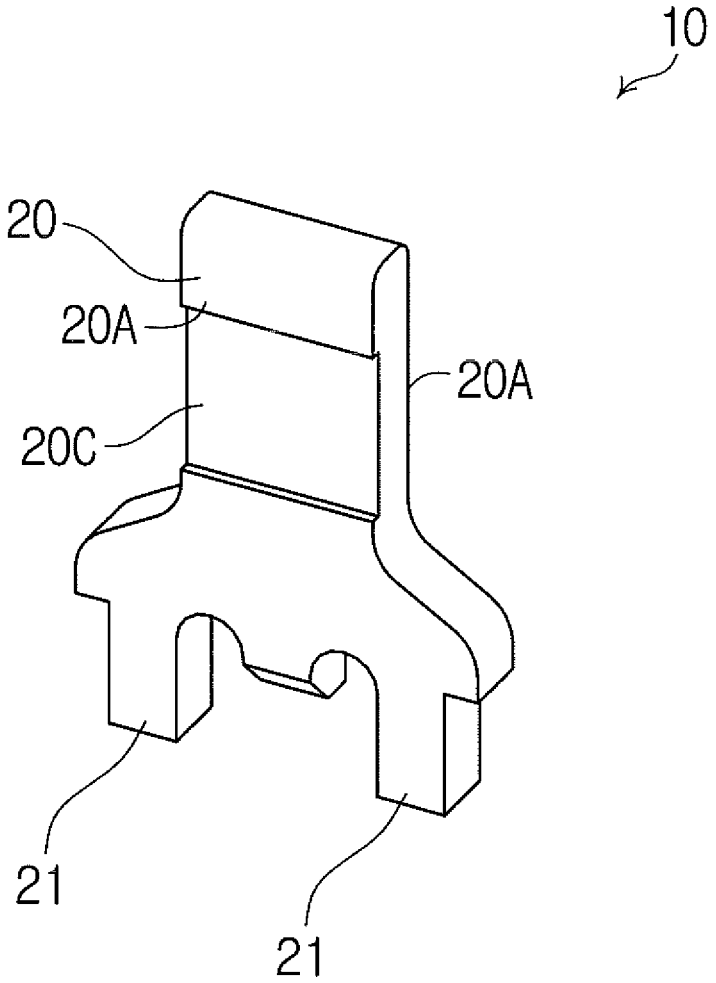
FIG. 13 is a perspective view showing another modified example of the upper plug contact.

In the above exemplary embodiment, as shown in FIG. 4, each upper plug contact 10 has a flat plate shape and is formed by punching a metallic plate. In this case, in order to produce a click feeling during mating of the upper plug contact 10 with the corresponding lower receptacle contact 13, for example, as shown in FIG. 12, an opening 20B or a projection (not shown) may be formed in the contact portion 20 of the upper plug contact 10. Similarly, in order to produce a click feeling during mating of the upper plug contact 10 with the lower receptacle contact 13, as shown in FIG. 13, for example, a dent 20C may be formed by a coining process in at least one of the principal surfaces 20A of the contact portion 20 of the upper plug contact 10. Herein assume that the upper plug contacts 10 having a flat plate shape encompass not only the upper plug contact 10 shown in FIG. 4, but also the upper plug contacts 10 in which the opening 20, the projection, or the dent 20 is formed as shown in FIGS. 12 and 13.

From the invention thus described, it will be obvious that the embodiments of the invention may be varied in many ways. Such variations are not to be regarded as a departure from the spirit and scope of the invention, and all such modifications as would be obvious to one skilled in the art are intended for inclusion within the scope of the following claims.

What is claimed is:

1. A connector assembly comprising:

a first connector including a plurality of first plug contacts and a plurality of first receptacle contacts each having a first elastic piece, the plurality of first plug contacts and the plurality of first receptacle contacts being alternately arranged in a grid array; and a second connector including a plurality of second plug contacts and a plurality of second receptacle contacts each having a second elastic piece, the plurality of second plug contacts and the plurality of second receptacle contacts being alternately arranged in a grid array, wherein the plurality of first plug contacts are each brought into contact with the second elastic piece of the corresponding second receptacle contact in accordance with elastic deformation of the second elastic piece, the plurality of second plug contacts are each brought into contact with the first elastic piece of the corresponding first receptacle contact in accordance with elastic deformation of the first elastic piece, and a direction of the elastic deformation of the first elastic piece is different from a direction of the elastic deformation of the second elastic piece in a state in which the first connector and the second connector are mated, and in the state in which the first connector and the second connector are mated, the first elastic piece is elastically deformed in a direction perpendicular to a thickness direction of the first receptacle contacts, and the second elastic piece is elastically deformed in a direction perpendicular to a thickness direction of the second receptacle contacts.

2. The connector assembly according to claim 1, wherein in the state in which the first connector and the second connector are mated, the direction of the elastic deformation of the first elastic piece is different from the direction of the elastic deformation of the second elastic piece by about 90 degrees.

3. The connector assembly according to claim 1, wherein a plate thickness of each of the first plug contacts is the same as a plate thickness of each of the first receptacle contacts.

4. The connector assembly according to claim 1, wherein a planar shape of each of the first plug contacts is the same as a planar shape of each of the second plug contacts, and a planar shape of each of the first receptacle contacts is the same as a planar shape of each of the second receptacle contacts.

5. The connector assembly according to claim 1, wherein the first plug contact and the second plug contact are each formed into a flat plate shape.

6. The connector assembly according to claim 5, wherein a thickness direction of the first plug contacts is the same as a thickness direction of the first receptacle contacts adjacent to the first plug contacts in a direction perpendicular to the thickness direction of the first plug contacts.

7. The connector assembly according to claim 6, wherein the first plug contacts are each formed in such a manner that the first plug contacts are each narrowed at a leading end thereof, the leading end projecting toward the second connector.

8. The connector assembly according to claim 6, further comprising a plurality of first housing divided bodies, wherein each of the first housing divided bodies holds the plurality of first plug contacts and the plurality of first receptacle contacts that are alternately arranged in the direction perpendicular to the thickness direction of the first plug contacts.

9. The connector assembly according to claim 8, wherein each of the first housing divided bodies comprises two holding members that hold the plurality of first plug contacts and the plurality of first receptacle contacts by sandwiching the plurality of first plug contacts and the plurality of first receptacle contacts in the thickness direction of the first plug contacts, the first plug contacts and the first receptacle contacts being alternately arranged in the direction perpendicular to the thickness direction of the first plug contacts.

10. The connector assembly according to claim 1, wherein each of the first receptacle contacts has two first elastic pieces, and the two first elastic pieces have different shapes.

11. The connector assembly according to claim 10, wherein any one of the plurality of first receptacle contacts is reversely positioned with respect to the other first receptacle contacts.

12. A connector assembly comprising:

a first connector including a plurality of first plug contacts and a plurality of first receptacle contacts each having a first elastic piece, the plurality of first plug contacts and the plurality of first receptacle contacts being alternately arranged in a grid array; and a second connector including a plurality of second plug contacts and a plurality of second receptacle contacts each having a second elastic piece, the plurality of second plug contacts and the plurality of second receptacle contacts being alternately arranged in a grid array, wherein the plurality of first plug contacts are each brought into contact with the second elastic piece of the corresponding second receptacle contact in accordance with elastic deformation of the second elastic piece, the plurality of second plug contacts are each brought into contact with the first elastic piece of the corresponding first receptacle contact in accordance with elastic deformation of the first elastic piece, a direction of the elastic deformation of the first elastic piece is different from a direction of the elastic deformation of the second elastic piece in a state in which the first connector and the second connector are mated, and a thickness direction of the first plug contacts is the same as a thickness direction of the first receptacle contacts adjacent to the first plug contacts in a direction perpendicular to the thickness direction of the first plug contacts.

* * * * *